US010041766B2

(12) United States Patent
Maughn

(10) Patent No.: US 10,041,766 B2
(45) Date of Patent: Aug. 7, 2018

(54) SIGHTING DEVICE MOUNT

(71) Applicant: Alpine Manufacturing, LLC, Salt Lake City, UT (US)

(72) Inventor: Jason Maughn, Taylorsville, UT (US)

(73) Assignee: Alpine Manufacturing, LLC, Salt Lake City, UT (US)

( * ) Notice: Subject to any disclaimer, the term of this patent is extended or adjusted under 35 U.S.C. 154(b) by 0 days.

(21) Appl. No.: 15/429,317

(22) Filed: Feb. 10, 2017

(65) Prior Publication Data

US 2017/0234653 A1 Aug. 17, 2017

Related U.S. Application Data

(60) Provisional application No. 62/294,175, filed on Feb. 11, 2016.

(51) Int. Cl.
*F41G 11/00* (2006.01)

(52) U.S. Cl.
CPC ..... *F41G 11/003* (2013.01)

(58) Field of Classification Search
CPC ..... F41G 11/003; F41G 11/004
USPC ..... 42/124, 125, 127
See application file for complete search history.

(56) References Cited

U.S. PATENT DOCUMENTS 3,253,361 A * 5/1966 Kingsbury ..... F41G 11/003 42/124
3,611,606 A * 10/1971 Sefried et al. ..... F41G 11/003 42/124
4,026,055 A * 5/1977 Weast ..... F41G 11/003 42/124
4,418,487 A * 12/1983 Strahan ..... F41G 11/001 42/125
4,429,468 A * 2/1984 Jimenez ..... F41G 11/003 42/111
6,705,038 B2 * 3/2004 Davenport ..... F41G 11/004 42/127
7,313,885 B1 * 1/2008 Looney ..... F41G 1/545 33/645
7,543,405 B1 6/2009 Ivey
8,528,140 B1 9/2013 Phillips et al.
D787,007 S * 5/2017 Maughn ..... D22/108
2011/0197491 A1 8/2011 McCann
2016/0010946 A1 1/2016 Gibbens et al.
2016/0363416 A1 12/2016 Klotz

* cited by examiner

*Primary Examiner* — Reginald Tillman, Jr.

(74) *Attorney, Agent, or Firm* — Thorpe North & Western LLP

(57) ABSTRACT

A removable sighting device mount is disclosed having an elongate top member configured to removably receive a sighting system thereon, the elongate top member removably attachable to a firearm. The device has a first elongate arm having a longitudinal axis that is parallel to the elongate top member, the first elongate arm having an elongate tab configured to mate with a first slot disposed in a receiver of the firearm. The device also has a second elongate arm, disposed opposite the first elongate arm, having a longitudinal axis that is parallel to the elongate top member. The second elongate arm has an elongate tab configured to mate with a second slot disposed in the receiver of a firearm.

8 Claims, 4 Drawing Sheets

SIGHTING DEVICE MOUNT

CLAIM OF PRIORITY

This application claims priority to U.S. Provisional Application Ser. No. 62/294,175 filed on Feb. 11, 2016 entitled "Sighting Device Mount" which is incorporated herein by reference in its entirety.

FIELD OF THE TECHNOLOGY

The present technology relates to devices, methods, and systems for mounting a sighting device to a firearm.

BACKGROUND OF THE TECHNOLOGY AND RELATED ART

The present invention relates generally to an apparatus and method of attaching and aligning an optical targeting or alignment system to a base. More particularly, this invention pertains to an apparatus and method of attaching and aligning optical sighting systems to a firearm.

It is long known in the art to provide mechanical means for mounting optical devices to a firearm. Aiming or sighting devices, laser target illumination devices and laser ranging devices are commonly mounted to ballistic projectile launchers, such as rifles, to survey equipment, and to other apparatus requiring alignment along a longitudinal axis. Common aiming or sighting devices include various types of telescopic optical scopes. Other aiming or sighting devices include telescopic and non-telescopic thermal imaging scopes and telescopic and non-telescopic amplified light imaging optical scopes.

Removable mounting systems are frequently used to mount telescopic scopes, and other similar aiming devices (e.g., iron sights), upon barrels of rifles or other similar firearms. The most common telescopic scopes are non-amplified, optical telescopic scopes having front and rear mounting points. Such a telescopic scope (or other sighting device) is attached by means of a mounting system to the barrel of a rifle in a configuration having the rear sight of the scope adjacent to the rifle's breach and the front sight of the scope directed toward the muzzle of the rifle. The scope's sighting axis is approximately aligned with the bore axis of the rifle and is adjusted vertically in elevation and adjusted laterally in windage such that the point of aim observed by the shooter is the point of impact of the projectile at the desired range.

A problem with current mounting systems includes impingement of the frame (e.g., the receiver) of the firearm. Impingement upon the receiver can interfere with the bolt carrier and result in jamming of the firearm. That is, current systems used in connection with select firearms rely on a frictional fit about the top of the receiver of the firearm resulting in compression to the receiver in the area about the bolt carrier. It is therefore desirable to have a sighting device mount for select firearms that does not impinge upon the receiver.

SUMMARY OF THE INVENTION

In light of the problems and deficiencies inherent in the prior art, the present invention seeks to overcome these by providing an apparatus for removably placing a sighting device (such as a scope) mount to a firearm. In accordance with one aspect of the technology, the sighting device mount comprises an elongate top member configured to removably receive a sighting system thereon, the elongate top member removably attachable to a firearm. A first elongate arm is attached to the elongate top member having a longitudinal axis that is parallel to the elongate top member, the first elongate arm having an elongate tab configured to mate with a first slot disposed in the receiver of the firearm. A second elongate arm is attached to the elongate top member, disposed opposite the first elongate arm, having a longitudinal axis that is parallel to the elongate top member, the second elongate arm having an elongate tab configured to mate with a second slot disposed in the receiver of the firearm.

BRIEF DESCRIPTION OF THE DRAWINGS

The present technology will become more fully apparent from the following description and appended claims, taken in conjunction with the accompanying drawings. Understanding that these drawings merely depict exemplary aspects of the present technology they are, therefore, not to be considered limiting of its scope. It will be readily appreciated that the components of the present technology, as generally described and illustrated in the figures herein, could be arranged and designed in a wide variety of different configurations. Nonetheless, the technology will be described and explained with additional specificity and detail through the use of the accompanying drawings in which:

DETAILED DESCRIPTION OF EXEMPLARY ASPECTS OF THE TECHNOLOGY

The following detailed description of exemplary aspects of the technology makes reference to the accompanying drawings, which form a part hereof and in which are shown, by way of illustration, exemplary aspects in which the technology may be practiced. While these exemplary aspects are described in sufficient detail to enable those skilled in the art to practice the technology, it should be understood that other aspects may be realized and that various changes to the technology may be made without departing from the spirit and scope of the present technology. Thus, the following more detailed description of the aspects of the present technology is not intended to limit the scope of the technology, as claimed, but is presented for purposes of illustration only and not limitation to describe the features and characteristics of the present technology, to set forth the best mode of operation of the technology, and to sufficiently enable one skilled in the art to practice the technology. Accordingly, the scope of the present technology is to be defined solely by the appended claims. The following detailed description and exemplary aspects of the technology will be best understood by reference to the accompanying drawings, wherein the elements and features of the technology are designated by numerals throughout.

The present technology describes systems, devices, and methods for mounting a sighting device to a firearm. As used herein, the term "sighting device" or "sighting system" includes, but without limitation, scopes, laser sights, and iron sights. Previous practices fall short of providing optimal mounting devices due, in part, to impingement upon the top of the bolt carrier of the firearm resulting in jamming of the firearm. Generally speaking, in one aspect of the technology, a scope mount is provided for placement within slots disposed within the frame or receiver of a firearm. Advantageously, placement of the scope mount about the frame within the slots does not impinge upon the bolt carrier or otherwise effect operation of the firearm.

Figure 1:
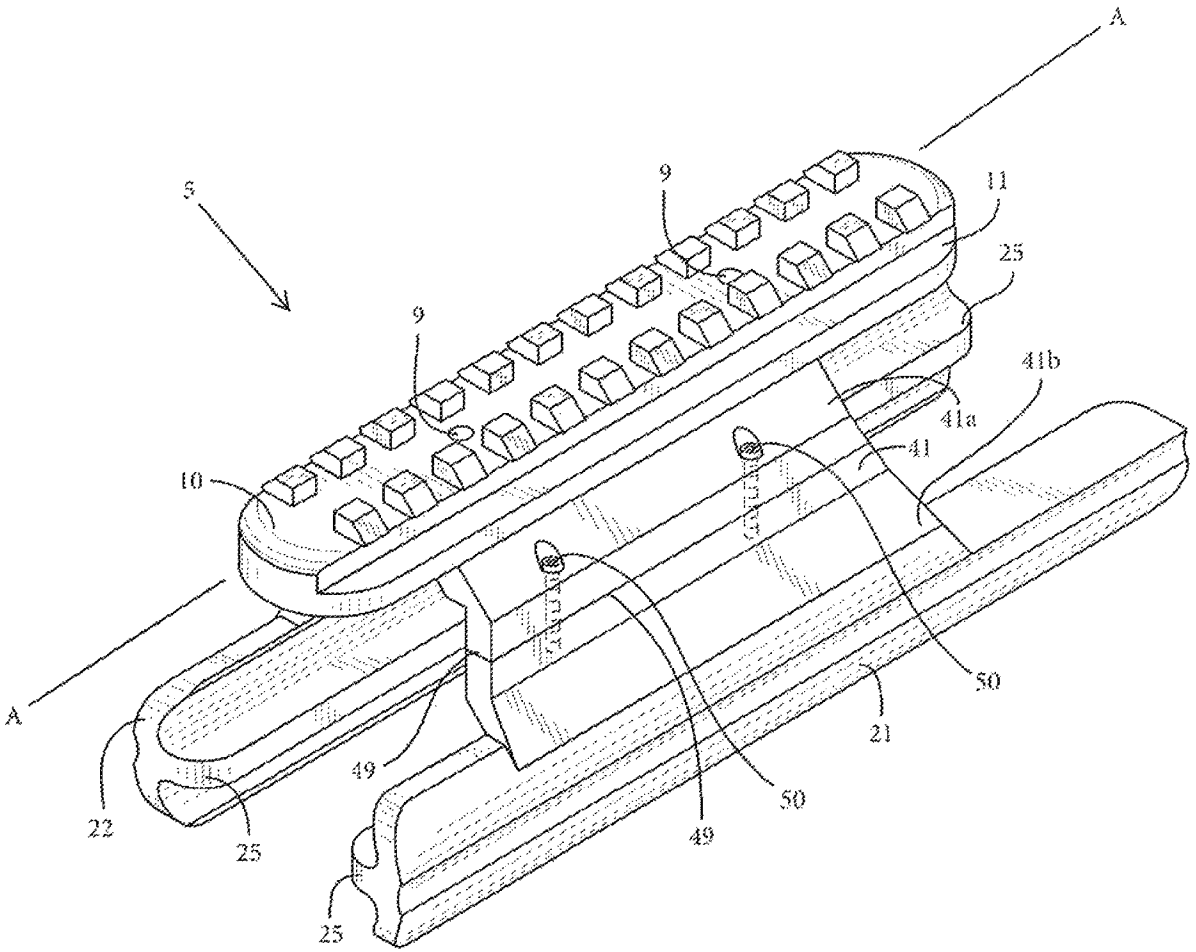
FIG. 1 is a perspective view of a mount in accordance with one aspect of the technology.
Figure 2:
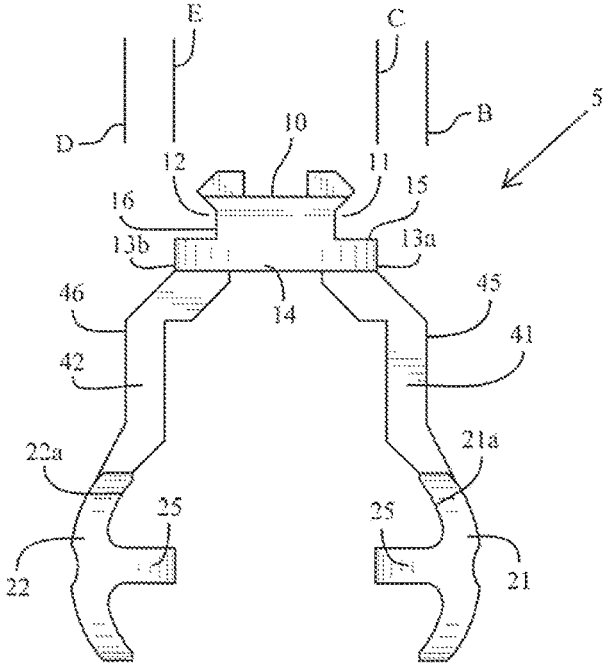
FIG. 2 is a cross sectional view of a mount in accordance with one aspect of the technology.

With reference now to FIG. 1, a sighting device mount 5 is disclosed comprising an elongate top member 10 having a first channel 11 disposed about a first side of the elongate top member 10 and a second channel 12 disposed about a second side of the elongate top member 10. The first and second channels 11, 12 are defined at least by opposing outside walls 13 of a base 14 of the elongate top member 10. They are further defined by a bottom wall 15 and internal side walls 16. The elongate top member 10 is not unlike a Picatinny rail and can comprise a Picatinny rail in aspects of the technology that provide channels for the clamping mounting of an optical device thereon. The sighting device mount 5 has first 21 and second 22 elongate arms, each having a longitudinal axis A that is parallel to the elongate top member 10. Each of the first 21 and second 22 elongate arms has an elongate tab 25 configured to mate with a first 31 and second 32 slot disposed in the frame 30 (i.e., the receiver) of a firearm 50. In firearms terminology, the receiver 30 is the part of a firearm that houses the operating parts. There are many types and styles of firearm receivers. A bolt action or semi-automatic firearm receiver usually contains the bolt carrier group, trigger group, and magazine port.

The mount 5 further comprises first 41 and second 42 bridges extending downward from the elongate top member 10 to the first 21 and second 22 elongate arms. Each of the first 41 and second 42 bridges have an outside wall 45. An imaginary plane B extending across the outside wall 45 of the first bridge 41 is disposed outside an imaginary plane C extending across an outside wall 13*a* of the elongate top member 10. Likewise, an imaginary plane D extending across the outside wall 46 of the second bridge 42 is disposed outside an imaginary plane E extending across an outside wall 13*b* of the elongate top member 10. An internal wall 47 of the first bridge 41 has an imaginary plane F extending across the internal wall 47 that is parallel with an imaginary plane G extending across an outer wall 33 of the frame 30 of the firearm 50. An internal wall 48 of the second bridge 42 has an imaginary plane H extending across the internal wall 48 that is parallel with an imaginary plane I extending across an outer wall 34 of the frame 30.

Figure 3:
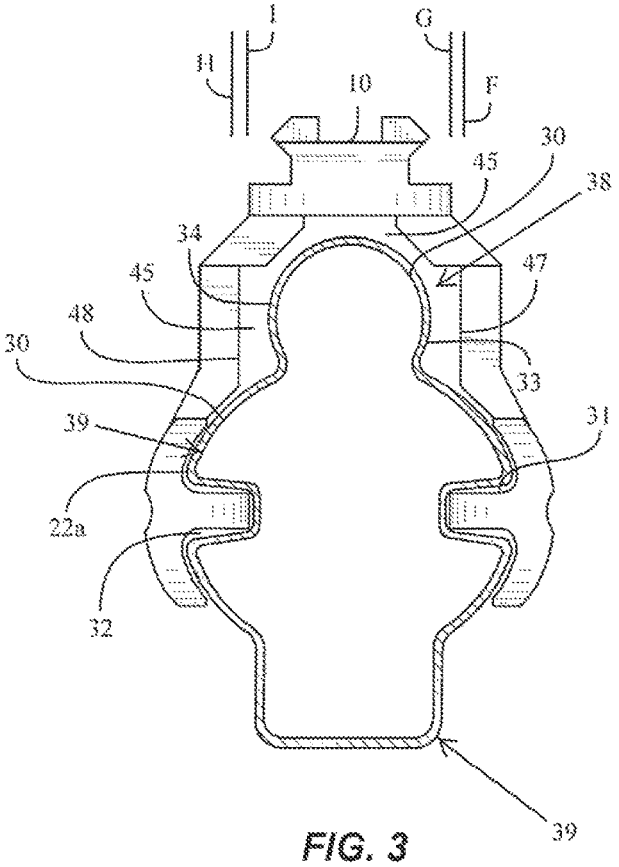
FIG. 3 is a cross sectional view of a mount disposed about a frame of a firearm in accordance with one aspect of the technology.
Figure 4:
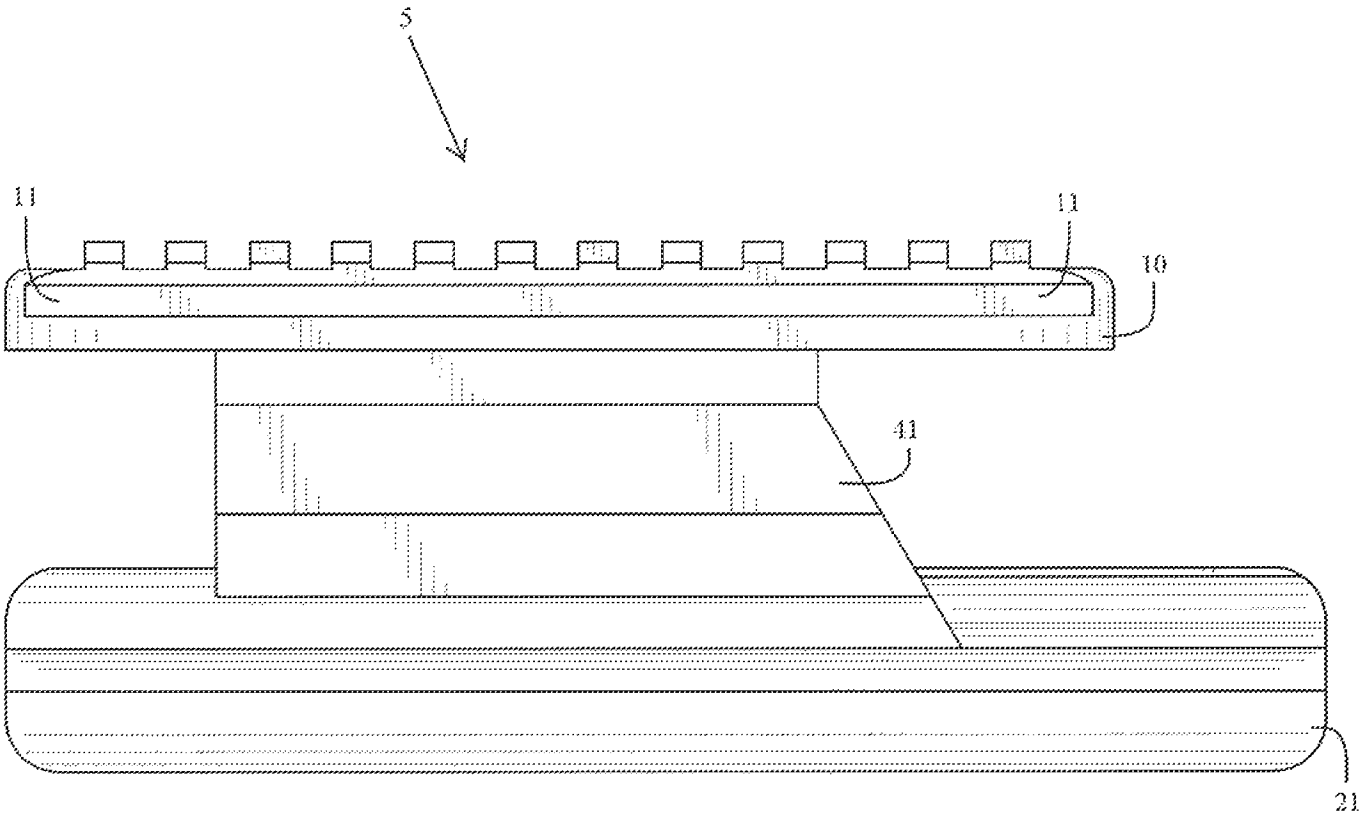
FIG. 4 is a side view of a mount in accordance with one aspect of the technology.
Figure 5:
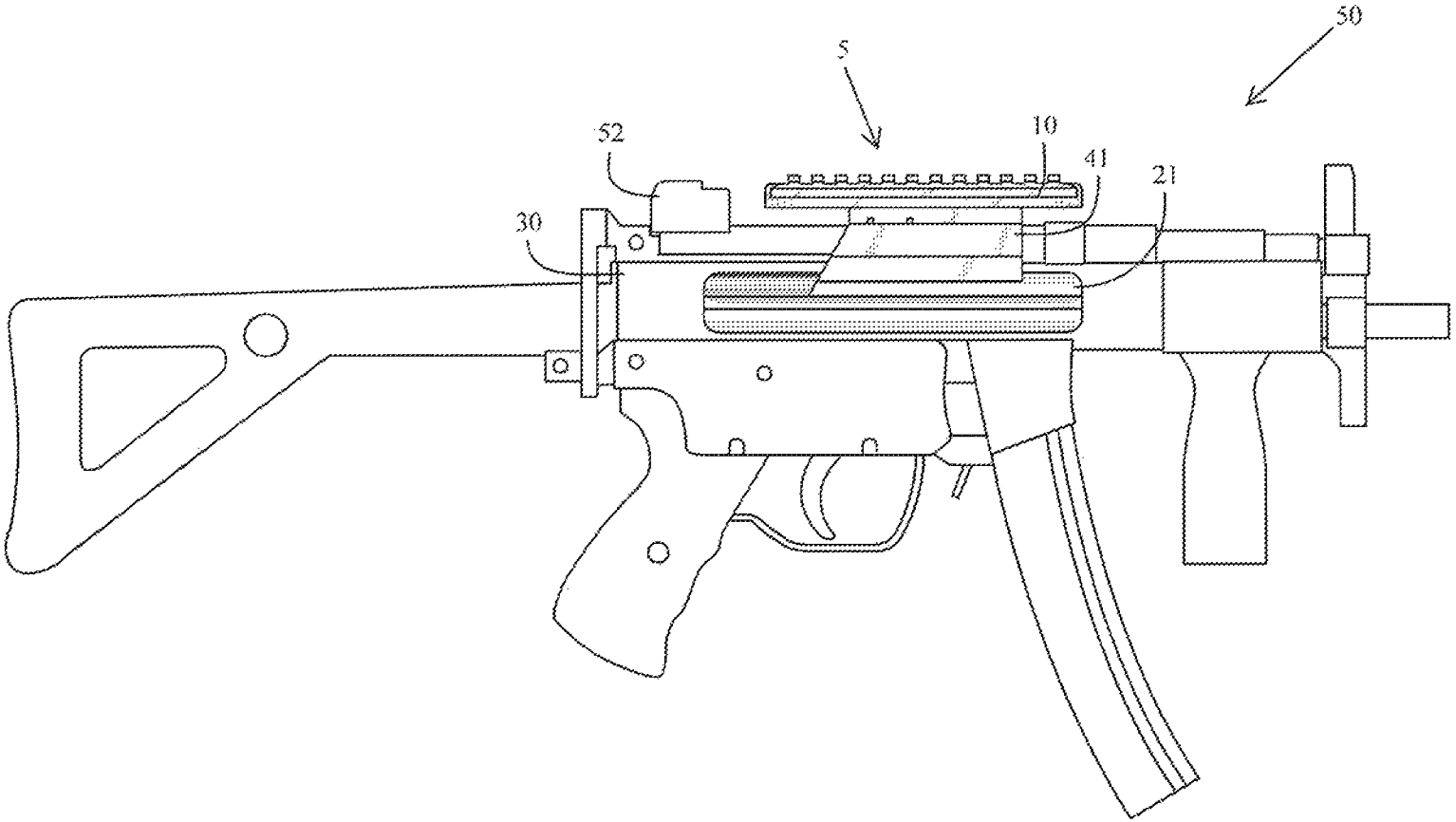
FIG. 5 is a side view of a mount disposed on a firearm in accordance with one aspect of the technology.

With reference now generally to FIGS. 1-5, with more specific reference to FIGS. 3-5, an optical device (i.e., a scope) mount 10 is shown disposed about the frame of a firearm 50. In accordance with one aspect of the technology, the first 21 and second 22 elongate arms have an internal radius of curvature 21*a*, 22*a* that is equivalent to an outside radius of curvature of the frame 30 of a firearm 50. The frame (or receiver) 30 of the firearm 50 comprises an upper curvilinear section 38 and a bottom rectangular section 39. In one aspect, the frame 30 comprises the receiver of the firearm 50 and houses at least the bolt carrier group. In one aspect, the bolt carrier group comprises a gas key, cam pin, firing pin, firing pin retaining pin, and/or a bolt assembly. A side portion of the receiver 30 comprises longitudinal slots 31, 32 disposed on opposing sides of the receiver 30. The slots 31, 32 are disposed in a direction that is parallel with the direction of travel of the bolt carrier and the barrel of the firearm 50 which is also parallel with a longitudinal axis A of the elongate top member 10. In one aspect of the technology, the barrel and trunnion of the firearm 50 are mounted forward of the slots 31, 32 disposed in the receiver 30. In another aspect, the carrier bolt of the firearm 50 is disposed, at least partially, between the opposing slots 31, 32.

In one aspect of the technology, the slots 31, 32 have a depth of ⅛ inch to ½ inch and a length ranging from 3 to 5 inches, though other dimensions are useable. The depth of the slots 31, 32 is substantially equivalent to the depth of the tabs 25 on the opposing elongate arms 21, 22. In one aspect of the technology, the tabs 25 are configured for a frictional fit within the slots 31, 32. In one aspect, the width of the tabs 25 is larger than the width of the slots 31, 32 so that the tabs 25 will frictionally engage the slots 31, 32. In another aspect, the tabs 25 are tapered so that they have a larger width towards the inner wall of the arms 21, 22 and a smaller width towards the inside of slots 31, 32. In one aspect of the technology, the radius of curvature of a portion of the side sections of the receiver 30 is equivalent to the radius of curvature of at least an inner wall 21*a*, 22*a* of opposing elongate arms 21, 22. The elongate arms 21, 22 are sized to approximate the length of the slots 31, 32 in the receiver 30, though the arms 21, 22 may be shorter or longer as suits a particular purpose. However, the tabs 25 will not be longer than the longitudinal length of the slots 31, 32. In another aspect, the tabs 25 do not frictionally fit within the slots 31, 32 but are slidable within the slots 31, 32.

In one aspect, the first and second bridges 41, 42 that connect the arms 21, 22 to the elongate top member 10 have a longitudinal length that is less than the length of the arms 21, 22. In one aspect of the technology, the top elongate member 10 is integrally formed with the first and second bridges 41, 42 and the first and second elongate arms 21, 22. In another aspect, the top elongate member 10 is detachable from at least one of the first and second bridges 41, 42. In the instance where the top elongate member 10 is integrally formed with the first and second bridges 41, 42, the bridge is sized and configured to provide a gap 45 between the inner walls of the bridge 41, 42 and the base 14 of the elongate top member 10. A gap 45 is also provided between sidewalls of the receiver and the bridge. In this manner, the mounting device 10 can be slidably mounted onto the receiver 30 over the rear mounting bracket 52 of the firearm 50. In the instance where the top elongate member 10 is detachable from at least one of the first and second bridges 41, 42, the bridge is sized and configured with less of a gap 45. Any number of means known in the art may be employed to attach and detach the bridge to the elongate top member 10, including threaded bolts, biased spring members, clamps, and the like. For example, a pair of threaded bolts is shown on FIG. 1 coupling an upper portion 41*a* of bridge 41 to a lower portion 41*b* of bridge 41. The upper portion 41*a* and lower portion 41*b* are separated by break 49 between the two pieces. In an additional aspect, a plurality of apertures 9 are disposed through the elongate top member 10 to permit placement of nylon tip screws through the apertures 9. The nylon tipped screws engage a top surface of the firearm 50 to frictionally fit the mounting device 5 to the firearm 50.

The mounting device 5 can be machined from a single metal or metal alloy, cast as a single component, or cast and assembled from multiple parts. It can also be formed from reinforced carbon, reinforced polymers, or other rigid materials known in the art.

The foregoing detailed description describes the technology with reference to specific exemplary aspects. However, it will be appreciated that various modifications and changes can be made without departing from the scope of the present technology as set forth in the appended claims. The detailed description and accompanying drawings are to be regarded as merely illustrative, rather than as restrictive, and all such modifications or changes, if any, are intended to fall within the scope of the present technology as described and set forth herein.

More specifically, while illustrative exemplary aspects of the technology have been described herein, the present technology is not limited to these aspects, but includes any and all aspects having modifications, omissions, combinations (e.g., of aspects across various aspects), adaptations and/or alterations as would be appreciated by those skilled in the art based on the foregoing detailed description. The limitations in the claims are to be interpreted broadly based on the language employed in the claims and not limited to examples described in the foregoing detailed description or during the prosecution of the application, which examples are to be construed as non-exclusive. For example, in the present disclosure, the term "preferably" is non-exclusive where it is intended to mean "preferably, but not limited to." Any steps recited in any method or process claims may be executed in any order and are not limited to the order presented in the claims. Means-plus-function or step-plus-function limitations will only be employed where for a specific claim limitation all of the following conditions are present in that limitation: a) "means for" or "step for" is expressly recited; and b) a corresponding function is expressly recited. The structure, material or acts that support the means-plus-function are expressly recited in the description herein. Accordingly, the scope of the technology should be determined solely by the appended claims and their legal equivalents, rather than by the descriptions and examples given above.

The invention claimed is:

1. A firearm and sighting device mount assembly, comprising:

a firearm having a frame, the frame of the firearm comprising a curvilinear section, the curvilinear section comprising first and second opposing slots disposed parallel with a longitudinal axis of a barrel of the firearm;

an elongate top member configured to removably receive a sighting system thereon, the elongate top member removably attachable to the firearm;

a first elongate arm attached to the elongate top member having a longitudinal axis that is parallel to the elongate top member, the first elongate arm having an elongate tab configured to mate with the first slot disposed in the frame of the firearm; and a second elongate arm attached to the elongate top member, disposed opposite the first elongate arm, having a longitudinal axis that is parallel to the elongate top member, the second elongate arm having an elongate tab configured to mate with the second slot disposed in the frame of the firearm, wherein the frame of the firearm comprises an external radius of curvature, and an internal wall of the first and second elongate arms comprises an internal radius of curvature that is equivalent to the external radius of curvature of the frame of the firearm.

2. The assembly of claim 1, further comprising a first and second bridge extending downward from the elongate top member to the first and second elongate arms, the first and second bridges having an outside wall, wherein an imaginary plane extending across the outside wall of the first bridge is disposed outside an imaginary plane extending across a first outside wall of the elongate top member, and an imaginary plane extending across the outside wall of the second bridge is disposed outside an imaginary plane extending across a second outside wall of the elongate top member.

3. The assembly of claim 1, further comprising a first and second bridge extending downward from the elongate top member to the first and second elongate arms, wherein the first and second bridges have a longitudinal length that is less than a longitudinal length of the first and second arms.

4. The assembly of claim 1, wherein the first and second arms have a longitudinal length that is equivalent to a longitudinal length of the first and second slots in the frame of the firearm.

5. The assembly of claim 1, wherein at least one of the first and second arms are detachable from the elongate top member.

6. The assembly of claim 3, wherein the first and second bridge and elongate arms are integrally formed with the elongate top member.

7. The assembly of claim 1, wherein the first and second slots have a depth that is substantially equivalent to a depth of the first and second tabs.

8. The assembly of claim 1, wherein a portion of a carrier bolt of the firearm is disposed at least partially between the first and second slots.

* * * * *